US007354351B2

(12) United States Patent
Edwards

(10) Patent No.: US 7,354,351 B2
(45) Date of Patent: Apr. 8, 2008

(54) FALSE SURFACE FOR AMUSEMENT RIDE SPECIAL EFFECT

(75) Inventor: Ross Edwards, Universal City, CA (US)

(73) Assignee: Universal City Studios LLLP, Universal City, CA (US)

( * ) Notice: Subject to any disclaimer, the term of this patent is extended or adjusted under 35 U.S.C. 154(b) by 292 days.

(21) Appl. No.: 11/292,458

(22) Filed: Dec. 2, 2005

(65) Prior Publication Data

US 2007/0167244 A1 Jul. 19, 2007

(51) Int. Cl.
*A63G 1/34* (2006.01)

(52) U.S. Cl. ..... 472/43; 472/59; 472/61; 472/134; 104/53; 434/62

(58) Field of Classification Search ..... 472/43, 472/59, 60, 61, 134, 136, 137; 104/53, 77, 104/78, 83; 434/29, 55, 62, 69
See application file for complete search history.

(56) References Cited

U.S. PATENT DOCUMENTS 4,347,791 A 9/1982 Mandros
5,245,799 A 9/1993 Sugiyama
5,453,053 A 9/1995 Danta
5,772,535 A * 6/1998 Murphy ..... 473/415
6,397,755 B1 * 6/2002 Kamler ..... 104/53

FOREIGN PATENT DOCUMENTS

DE 20319396 U1 3/2005
WO 0035200 A1 6/2000

* cited by examiner

*Primary Examiner*—Kien Nguyen
(74) *Attorney, Agent, or Firm*—Global Patent Operation; Mark A. Conklin

(57) ABSTRACT

A pair of opposed inflatable bladders form a false floor, ceiling or wall having a seam through which an object support is propelled, deforming the inflatable bladders around the support, thereby giving the appearance that an object mounted on the support above the bladders is self-propelled above the false floor, ceiling or wall.

12 Claims, 4 Drawing Sheets

FALSE SURFACE FOR AMUSEMENT RIDE SPECIAL EFFECT

BACKGROUND OF THE INVENTION

The field of the invention relates to amusement or theme park attractions and rides. More particularly, the invention relates to a special effect simulating a floor, wall or ceiling for use in connection with an amusement or themed ride.

Various forms of amusement rides have been used for many years in amusement or theme parks. These rides include roller coasters, round rides, water rides and dark rides. Typically, rides of these types have a ride vehicle carrying guest riders which follows a fixed, closed-loop path. These types of rides are all made more interesting by interaction with dynamic scenery and special effects located proximate or adjacent the ride vehicle path. A common difficulty is to provide the best illusion of realism to guest riders with the scenery or special effects. This is particularly difficult when dynamic scenery is used to create the same illusion repeatedly in a short cycle time between the arrival and departure of ride vehicles. It is desirable to locate the mechanical elements driving dynamic scenery such as animated animals, vehicles or other objects out of view of the guest riders to maintain the highest level of realism.

A particular problem is found when providing a floor or surface which permits movement of a scenery item or prop that is visible to guest riders on one side of a floor and which is driven by a device hidden from view on the other side of the floor. For example, it is generally known in theaters to provide a stage with slots forming tracks for supporting an object for movement above the stage in view of the audience when the movement is driven by a motivator below the stage which is out of sight of the audience. The slots have a constant size and are always open, so that the slots are visible to members of the audience who are able to see the stage surface. The illusion of the prop's self-powered movement is reduced as a result of the visibility of the fixed slot tracks. Such a solution is particularly ineffective in the case of amusement rides where all guest riders can easily see the slot tracks through which a supporting post for a scenery element moves on a path proximate the ride vehicle.

Similarly, an alternate solution in which dynamic scenery or effect mechanical components are located below a fixed floor in a hole accessible by show action doors is not ideal either. The closed action doors provide the appearance of a solid surface until they open to reveal the dynamic scenery to guest riders. As soon as the action doors open, however, whether by sliding or pivoting, the illusion that the space hiding the scenery or effect does not exist behind the doors is lost.

Accordingly, a need exists for an improved false floor, wall or ceiling for covering a space containing a driving mechanism for dynamic scenery or a special effect to maintain the illusion of the floor or surface during operation of the scenery or effect, and to thereby enhance the guest riders' overall ride experience.

BRIEF DESCRIPTION OF THE INVENTION

A false floor, wall or ceiling for a dark ride, high-speed ride, roller coaster or other ride system is formed from two or more inflatable deformable air bladders extending over a hole for hiding mechanical components of a dynamic scenery element or special effect. The bladders have edges which meet each other thereby defining a seam. The inflatable bladders are shaped to provide the illusion of a solid surface or floor over a space while permitting a support for a scenery element or effect to extend through the seam and to move along the seam, deforming the edges of the bladders around the support, so that the illusion of a floor is advantageously maintained, even as the scenery or effect mounted on the support is moved by the mechanical component. The support only deforms the bladders in the area of the seam where the support is present, so that guest riders do not see the hole for the mechanical components and the seam is not readily apparent either. The bladders may be camouflaged by scenery or other designs applied to the upper surface of each bladder and the surrounding floor, ceiling or wall, further enhancing the illusion of a rigid surface.

According to one embodiment, the bladders are air bags made from a readily deformable material. The air bags easily deform around the support so that gaps are not visible in the seam and the hole for the mechanical support remains hidden from the view of riders.

In a further alternative embodiment of the invention, the bladders have a readily deformable section adjacent the seam, and a relatively more rigid portion extending from the walls of the hole for the mechanical components. The more rigid section is not as readily deformable and so helps maintain the illusion of a rigid floor, even as the readily deformable portions of the bladders deform about the support.

In a still further embodiment of the invention, the bladders are used to form a false ceiling surface through which the support extends downwardly.

The various features of novelty which characterize the invention are pointed out with particularity in the claims annexed to and forming a part of this disclosure. For a better understanding of the invention, its operating advantages and benefits obtained by its uses, reference is made to the accompanying drawings and descriptive matter. The accompanying drawings are intended to show examples of the many forms of the invention. The drawings are not intended as showing the limits of all of the ways the invention can be made and used. Changes to and substitutions of the various components of the invention can of course be made. The invention resides as well in sub-combinations and subsystems of the elements described, and in methods of using them.

DETAILED DESCRIPTION OF THE INVENTION

Figure 1:
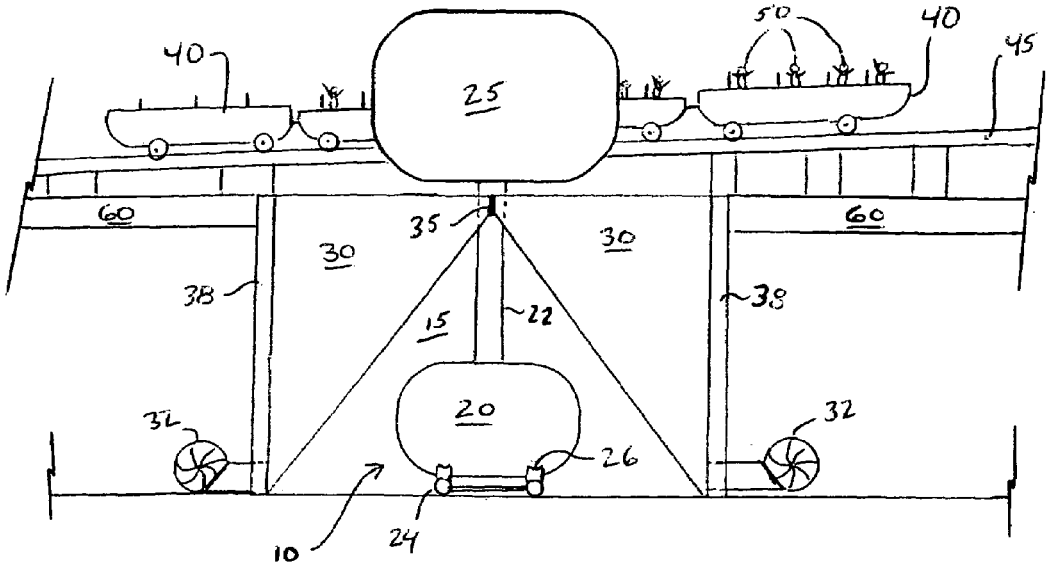
FIG. 1 is an end elevation view of a false surface system in accordance with one embodiment of the invention.

Referring now to the drawings in which like reference numerals are used to indicate the same or related elements, FIG. 1 illustrates a false surface system 10 in which a carriage 20 having a support post 22 is provided within a recess 15 below the floor 60 of a ride system, such as dark rides, roller coasters, round rides, themed rides and water rides, among others. The recess 15 is designed to hide carriage 20 and other mechanical components needed to activate or motivate a scenery object 25 for the ride system. The carriage 20 is mounted to a rail system 24 for guiding the movement of the carriage 20 using carriage wheels 26.

As shown in FIG. 1, the support post 22 extends upwardly from the carriage 20 through a seam 35 formed by a pair of opposed air bladders 30 extending from side walls 38 of the recess 15. The support post 22 is preferably cylindrical, but be of any cross-sectional shape, including an I-beam, rectangular, triangular and oval. A scenery element or prop 25 is mounted to support post 22 for movement with carriage 20 and post 22. The scenery element 25 is positioned on an opposite surface, or ride side, of the air bladders 30 and seam 35 from the carriage 20 and post 22, so that only scenery element 25 is visible to riders 50 in ride vehicle 40. As carriage 20 moves along rail system 24, the scenery element 25 is propelled above the false surface created by the air bladders 30, giving the illusion that the scenery element 25 is self-propelled to the riders 50.

The illusion of the scenery element 25 being self-propelled above the false surface is further enhanced by the air bladders 30 and seam 35. Air bladders 30 are made of a deformable material and have opposed edges which preferably contact each other without a gap to form seam 35. The air bladders 30 preferably have some thickness along their contacting edges forming the seam 35. As illustrated in FIG. 1, the air bladders 30 preferably taper from the side adjacent the supporting wall 38 to the contacting edges forming seam 35, so that sufficient space exists in the recess 15 for the mechanical components.

Fans 32 are provided for inflating air bladders 30 and maintaining the air bladders 30 in an inflated state during use of the false surface system 10. The support post 22 is arranged so that when carriage 20 moves, the support post 22 knifes along the split between the air bladders 30 that is the seam 35. The air bladders 30 are made from an easily deformable material, and the fans 32 are set to permit deformation of the air bladders 30. The portions of the air bladders 30 at the seam 35 adjacent the post 22 deform only enough to permit the post 22 to pass through and occupy space in the seam 35 while the air bladders 30 closely surround the post 22. The knifing movement of the post 22 through the seam 35 causes minimal disruption to the other portions of the air bladders 30.

Thus, when the scenery element 35 is selected to be sufficiently large to obscure post 22 and the portion of seam 35 below the scenery element 25, a rider 50 in the proximate ride vehicle is given the illusion that the scenery element 25 is moving above the false surface of the air bladders 30 on its own. Thus, the scenery element 25 may be a very light-weight prop having the appearance of a much heavier object and which is easily moved by the carriage 20 and rail system 24. For example, the scenery element 25 may simulate a large vehicle which appears to be on a collision course with the ride vehicle 40 on track 45, such as by approaching the ride vehicle 40 from one side. It should be noted, however, that the path for the ride vehicle 40 is not limited to a tracked systems or guide rail systems, but can include water flues, electronically defined paths and roadways.

The material used to form the air bladders 30 must be readily deformable, but able to hold some shape when inflated and absent some outside force pushing on the air bladders 30. Suitable materials for the air bladders 30 as disclosed herein include polyethylene, natural and synthetic fabrics, and natural and synthetic rubbers, among other materials. In one embodiment of the invention, the air bladders 30 may be air bags and can be made from the same materials commonly used for the air bags found in automobile safety devices.

Figure 2:
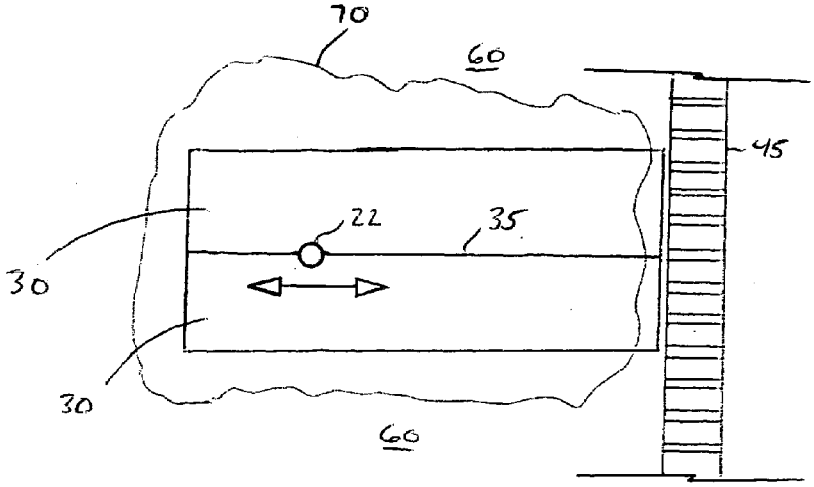
FIG. 2 is a top plan view of the system of FIG. 1.

FIG. 2 illustrates how the false floor of the air bladders 30 can be further disguised by using static scenery 70 or other camouflage. The static scenery 70 disguises the air bladders 30 and helps the floor 60 and air bladders 30 look like one surface, even though the air bladders do not form a rigid floor and instead cover a recess 15 in the floor 60. The static scenery 70 can be designed to fit into a theme of a themed ride along with a scenery element 25 mounted to post 22. According to one aspect of the invention, the static scenery 70 can be a painted design that is applied to the floor 60 and air bladders 30. The scenery element 25 (not shown in FIG. 2) moves toward and away from track 45 when a ride vehicle 40 is present. The combination of dynamic and static scenery elements 25, 70 enhances the overall ride experience for riders 50.

Figure 3:
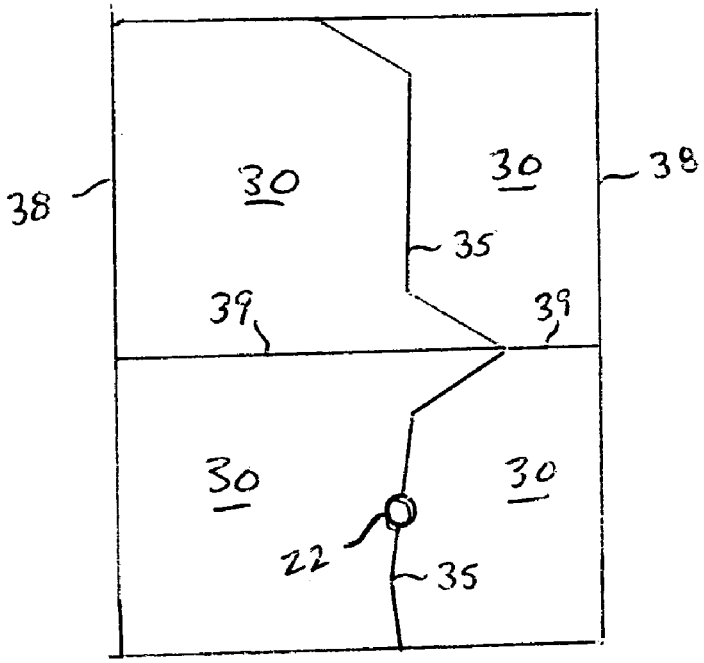
FIG. 3 is a top plan view of an alternate configuration of the bladders in accordance with another embodiment of the invention.
Figure 4:
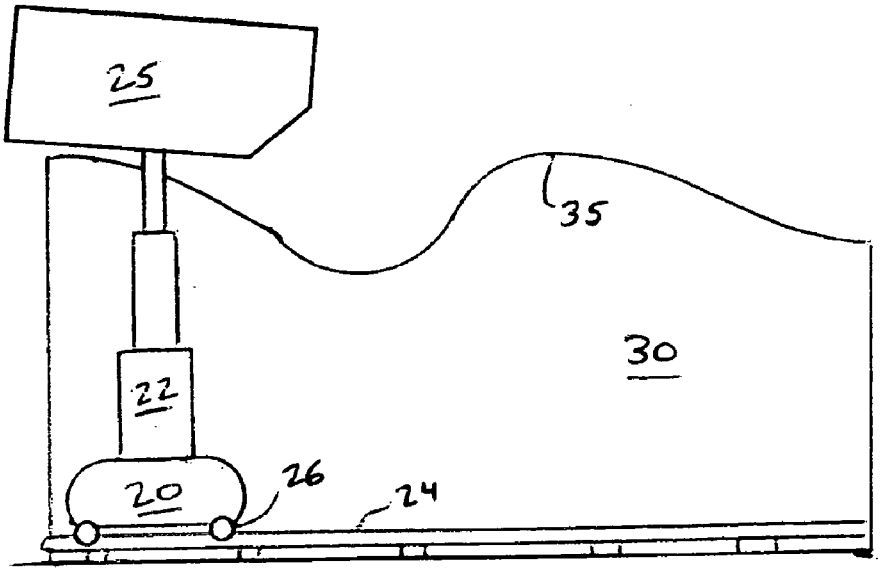
FIG. 4 is a side elevation view of a further alternate configuration of the bladders in accordance with another embodiment of the invention.

FIGS. 3 and 4 illustrate two further embodiments of the false floor system in which the seam 35 can vary in the horizontal plane (FIG. 3) or the vertical plane (FIG. 4). It is envisioned as well that non-linear movement in both the horizontal and vertical planes can be achieved.

As seen in FIG. 3, the seam 35 is not linear, but instead changes direction several times. Further, multiple air bladders 30 are provided to form the false surface covering the hole 15 between walls 38. Seams 35 are provided for post 22 to move through, while seams 39 between air bladders 30 are preferably joined securely, but seams 39 may be left open as well, so that multiple seam paths are provided for the support post 22 to move through. Each air bladder 30 can receive its own air supply from a connected air fan. Providing multiple bladders 30 allows the creation of more complex seam paths and minimizes the visible disturbance caused by movement of the support post 22 through the seams 35.

As will be appreciated, the track system 24 on which the carriage 20 moves must be adapted to the non-linear seam 35 in order to properly move the post 22 through the seam. Alternately, a different form of carriage 20 may be used, such as the one which will be described further herein in connection with FIG. 6. The seam 35 of FIG. 3 is provided to accommodate left and right movement in combination with forward and back movement through the seam 35.

In FIG. 4, the upper surface of the air bladders 30 are made to undulate, so that there is a vertical component to the movement of the scenery element 25. The post 22 is made to telescope so that the scenery element 25 can be moved up and down with the fluctuation of the surface.

Figure 5:
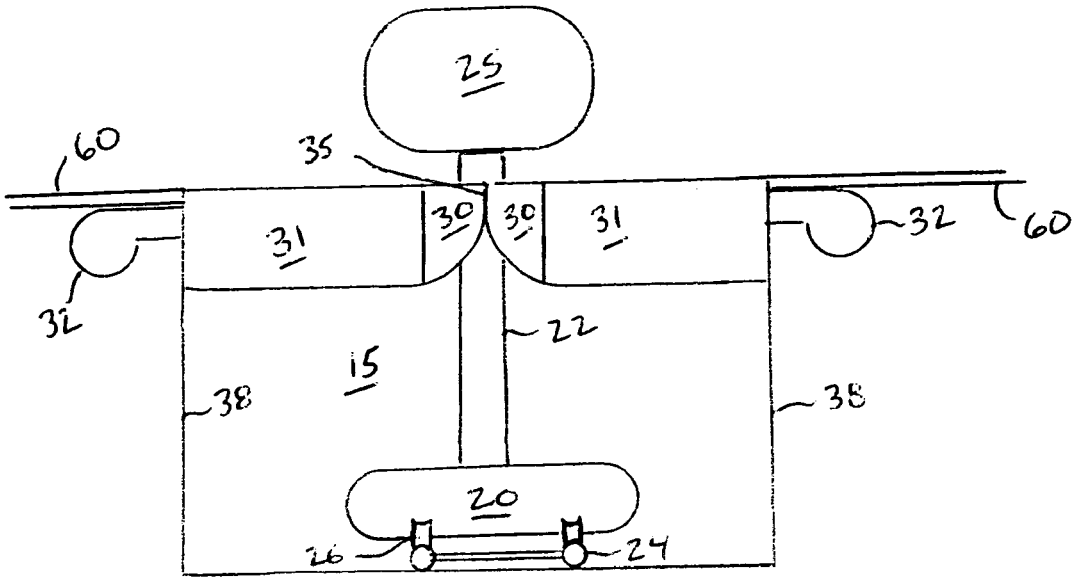
FIG. 5 is an end elevation view of yet another embodiment of the invention.

FIG. 5 shows an embodiment of the invention in which at least a portion of the air bladders is a more rigid material 31 closer to the wall 38. Portion 31 of each air bladder 30 is more rigid and less deformable than the portion of the respective air bladder 30 adjacent the seam 35. The more rigid portion 31 is less flexible and less susceptible to motion as the post 22 knifes through the seam 35 formed by the relatively flexible and easily deformable portions of the air bladder 30. The air bladders 30 can be made significantly thinner since the portions 31 are able to more readily support themselves by virtue of the more rigid construction. Accordingly, fans 32 are mounted near the underneath of floor 60 adjacent the recess 15 to be more accessible to the air bladders. More rigid portions 31 may be made from any material which is more rigid than the air bladder 30.

In a further embodiment of the system 10 in FIG. 5, portions 31 may form a supporting sleeve surrounding air bladder 30, so that only a small portion of air bladder 30 needed to deform around post 22 is exposed, while the remainder of the air bladder 30 is hidden from view. Alternatively, the more rigid portions 31 form a portion of the surface covering recess 15, so that the size of air bladders 30 is significantly reduced, while a relatively large recess 15 is covered.

Figure 6:
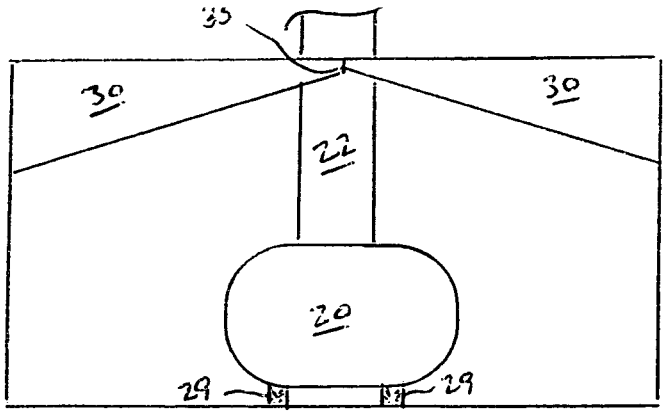
FIG. 6 is an end elevation view of a further embodiment of the invention.

The embodiment illustrated in FIG. 6 includes a carriage 20 which is adapted to move directly across the bottom of the hole 15 on wheels 29. If carriage 20 is provided with a steering wheel, it is easily adapted to use with the embodiment shown in FIG. 3, above. Further, FIG. 6 illustrates how the air bladders may be made thin so that more space is available in the recess 15 for the carriage 20 and other components.

Figure 7:
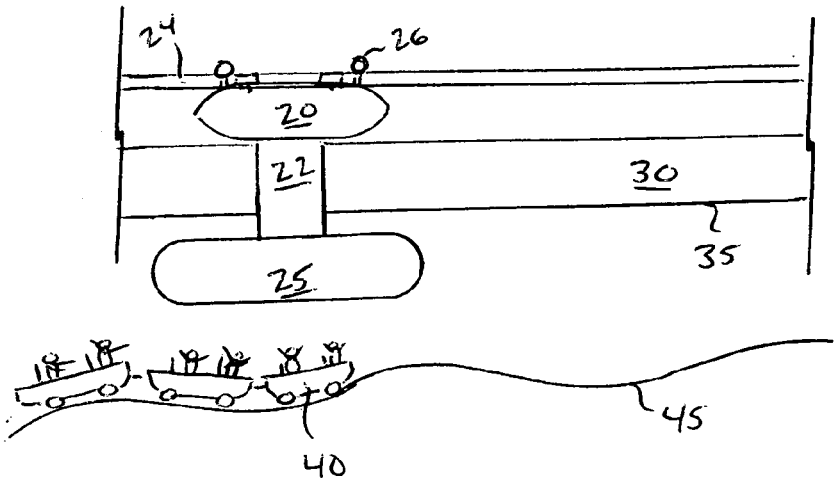
FIG. 7 is a side elevation view of a still further embodiment of the invention.

An embodiment of the invention in which the air bladders are used to form a false ceiling is illustrated in FIG. 7. The carriage 20 is mounted to an overhead track, while air bladders 30 are used to form a ceiling above ride track 45. In this embodiment, post 22 extends downwardly through the seam 35 in the bladders 30 toward the ride vehicle 40. It should be understood that the features illustrated above may be inverted for use in this embodiment of the false surface system. That is, even though the post 22 extends downwardly from a carriage hidden in the ceiling, the seam may be non-linear and/or have vertical changes, among other features.

It should be understood that while the bladders 30 have been shown forming a floor and a ceiling surface, than they are also adaptable to form walls. Further, the air bladders 30 can be shaped to form surfaces having slopes or contours so as to merge with surrounding surfaces where a recess for mechanical components of a scenery element are located.

Further, the support post 22 and carriage 20 may be replaced by a mechanical arm or other moving apparatus which can extend through the seam 35 to support and move a scenery element 25 along the seam 35.

While the present invention has been described with references to preferred embodiments, various changes or substitutions may be made on these embodiments by those ordinarily skilled in the art pertinent to the present invention with out departing from the technical scope of the present invention. Therefore, the technical scope of the present invention encompasses not only those embodiments described above, but all that fall within the scope of the appended claims.

What is claimed is:

1. A false surface system for a ride system comprising:

a pair of opposed air bladders extending from opposite walls defining a recess, the air bladders each having an edge contacting the other air bladder, the contacting edges forming a seam and the air bladders defining a surface on a ride side of the air bladders, the air bladders being readily deformable along the seam;

a carriage provided within the recess for moving within the recess;

a support post mounted to the carriage and extending through the seam for movement along the seam, the air bladders deforming about the support post as the post is moved along the seam by the carriage; and a scenery element mounted to the support post for enhancing the ride system for a rider, the scenery element obscuring the support post and seam deformation from a rider in a ride vehicle of the ride system.

2. The false surface system according to claim 1, further comprising a static scenery design applied to the ride side of the air bladders.

3. The false surface system according to claim 1, wherein the surface defined by the air bladders is one of a floor, ceiling and wall.

4. The false surface system according to claim 1, wherein the seam formed by the contacting edges is non-linear.

5. The false surface system according to claim 1, wherein each air bladder has a portion located adjacent the respective one of the opposing walls that is more rigid than the air bladder at the seam.

6. The false surface system according to claim 1, further comprising fan means for inflating the air bladders and maintaining a pre-determined pressure within the air bladders.

7. An effect for an amusement ride comprising:

a path for a ride vehicle of the amusement ride;

a recess having opposing walls adjacent the path;

a pair of air bladders extending across the recess from the opposing walls, the air bladders forming a surface covering the recess and defining a readily deformable seam between the air bladders; and motion means extending through the seam from the recess for supporting a scenery element on a ride vehicle side of the surface, the motion means for moving along the seam, the seam deforming around the motion means, keeping the recess obscured from riders in the ride vehicle.

8. The effect of claim 7, further comprising a static scenery design applied to the ride vehicle side of the air bladders.

9. The effect of claim 7, wherein the surface defined by the air bladders is one of a floor, ceiling and wall.

10. The effect of claim 7, wherein the seam is non-linear.

11. The effect of claim 7, wherein each air bladder has a portion located adjacent the respective one of the opposing walls that is more rigid than the air bladder at the seam.

12. The effect of claim 7, further comprising fan means for inflating the air bladders and maintaining a pre-determined pressure within the air bladders.

* * * * *